United States Patent [19]

Hardesty

[11] 3,998,514

[45] Dec. 21, 1976

[54] DEVICE ARMED WITH A TERMINAL FOR MAKING ELECTRICAL CONNECTION WITH A CONDUCTOR

[75] Inventor: Edwin Charles Hardesty, Perry Hall, Md.

[73] Assignee: Western Electric Company, Inc., New York, N.Y.

[22] Filed: Oct. 6, 1975

[21] Appl. No.: 620,629

[52] U.S. Cl. ..... 339/99 R; 339/217 R

[51] Int. Cl.[2] ..... H01R 13/40

[58] Field of Search ..... 339/95, 97–99, 339/217, 220, 221

[56] References Cited

UNITED STATES PATENTS

| | | | |
|---|---|---|---|
| 3,835,445 | 9/1974 | Hardesty | 339/99 R |
| 3,860,316 | 1/1975 | Hardesty | 339/99 R |
| 3,899,236 | 8/1975 | Santos | 339/98 |
| 3,936,128 | 2/1976 | D'Annessa et al. | 339/98 |

*Primary Examiner*—Joseph H. McGlynn
*Attorney, Agent, or Firm*—E. W. Somers

[57] ABSTRACT

A plug for terminating a cord in the field includes an unipartite, non-hinged, dielectric housing having a cord-input aperture, internal surfaces defining a cavity for receiving an end portion of the cord, jacket and conductor anchoring members, and facilities for supporting terminals in a partially seated position in terminal-receiving openings in the housing. The terminals have internal contacting portions for engaging cord conductors and external contacting portions for engaging electrically associated components of a telephone apparatus when the plug is inserted thereinto. The temporary terminal support facilities include webs formed integrally with the housing. Portions of the terminals are embedded in the webs while portions of the webs are reformed into clamping engagement with other portions of the terminals during the partial insertion of the terminals. This supports the terminals against unintended pivotal and linear movement and such that the internal contacting portions do not initially protrude into the cavity. This permits the plug to be assembled with an end portion of a cord after which forces are applied to the anchoring members to move them into clamping engagement with the jacket and with the conductors. Forces are subsequently or simultaneously applied to the terminals to further reform the webs and cause increased clamping engagement of the webs with the terminals as well as to permit the internal contacting portions to be moved into the cavity and into electrical engagement with the conductors received therein. The arrangement for supporting the terminals in a partially seated position is also useful in a multi-station assembly of a two part bonded housing.

16 Claims, 21 Drawing Figures

DEVICE ARMED WITH A TERMINAL FOR MAKING ELECTRICAL CONNECTION WITH A CONDUCTOR

BACKGROUND OF THE INVENTION

1. Field of the Invention

This invention relates to a device armed with a terminal for making electrical connection with a conductor, and more particularly, to devices for making electrical connections between a cord comprising flexible conductors and terminals and in which the terminals are inserted partially into a housing in a manufacturing environment in a manner which permits subsequent assembly of the device to the cord with attendant seating of the terminals therewithin to establish electrical connection of the terminals to the cord.

2. Description of the Prior Art

In the telephone industry, increasing use is being made of modular plug type connectors on retractile and straight cords which are used between the base and a handset of a telephone and between the base and a wall terminal block. See, for example, U.S. Pat. Nos. 3,699,498 and 3,761,869, issued Oct. 17, 1972 and Sept. 25, 1973, respectively, in the names of E. C. Hardesty, C. L. Krumreich, A. E. Mulbarger, Jr. and S. W. Walden.

Tinsel conductors are confined in conductor-receiving troughs formed in a dielectric base by a cover bonded to the base. Flat terminals are then inserted into individual grooves in the base in a side-by-side arrangement with contact portions thereof extending into engagement with the conductors. When the plug is inserted into a jack of a telephone handset or base or wall terminal block, portions of the terminals in the jack engage portions of associated terminals in the plug.

The assembly of modular plugs to cord ends may be accomplished as disclosed in U.S. Pat. Nos. 3,839,787 issued Oct. 8, 1974 in the names of W. B. Brown (deceased) and F. D. Gavin, Jr. and U.S. Pat. No. 3,895,434 issued July 22, 1975 in the names of G. P. Adams, F. D. Gavin, Jr. and A. P. Natale. The apparatus disclosed in those patents is specially adapted for manufacturing environments.

Plugs which include an unipartite dielectric housing that eliminates the need for hinged or bonded dielectric parts are also known. See U.S. Pat. No. 3,860,316 issued Jan. 14, 1975 in the name of E. C. Hardesty.

It is not uncommon that after a period of use, cords are refurbished by service organizations which generally do not have the capital investment in equipment found in a manufacturing environment. When cords are refurbished, it is desired to reterminate one or both ends of the cords with modular plugs.

Desirably, modular plugs are provided which have been factory assembled to the point of having the terminals thereof partially inserted. The service organizations then need only insert the cord and bond together the dielectric parts (U.S. Pat. No. 3,761,869) or actuate the strain relief facilities (U.S. Pat. No. 3,860,316) and seat completely the terminal blades.

The capability of assembling partially terminals to one part of a two part bonded plug is also useful in a manufacturing environment. Terminals may be inserted partially into the one part by the techniques disclosed in the aforementioned U.S. Pat. No. 3,839,787 after which the one part and a mating other part are assembled to an end portion of a cord by a simplified version of apparatus disclosed in the aforementioned U.S. Pat. No. 3,895,434.

The prior art includes connectors in which terminals are preassembled and partially seated in a housing. See U.S. Pat. Nos. 3,812,449 and 3,890,029. These generally include terminals having slotted openings which are oriented transverse of conductors to be engaged thereby and either are supported in a slideably moveable plastic support or are slideably insertable in slots in a dielectric housing. Slotted terminals are unacceptable for use in engaging electrically tinsel conductors. Further, the provisions for support thereof are not adaptable to the environment for telephone use and the absence of strain-relief facilities for the conductor places undesirably that function on the electrical connection.

SUMMARY OF THE INVENTION

This invention provides devices armed with terminals for establishing electrical connections to conductors. A dielectric housing of the device can be fabricated in one or two parts by using conventional molding techniques. Terminals are formed and seated partially within the housing. The device may be assembled to a line cord or to a retractile cord by field personnel in an operation which includes seating completely the terminals within the housing or may be used to insert terminals partially into a portion of the housing in one station of a multistation manufacturing operation.

An electrical connector for terminating a conductor and for engaging electrically a component external to the connector includes a dielectric housing which includes a conductor-receiving cavity and a terminal-receiving opening which communicates with the cavity, the terminal-receiving opening including a slot overlying and extending generally parallel to the cavity, the length of the slot being exposed to the exterior of the connector, an electrically conductive blade-like terminal having essentially flat parallel side surfaces spaced apart by end surfaces seated partially within the terminal-receiving opening and which includes an internal contact portion that extends into the cavity when the terminal is fully seated within the housing to pierce the insulation of and make electrical engagement with a conductor inserted in the cavity and an external contact portion for making electrical engagement with a component external to the connector, the terminal having barbs formed on end surfaces thereof, and facilities formed integrally with the housing and further defining the terminal-receiving opening for supporting the terminal within the opening to space the internal contact portion above the cavity with the barbs being embedded in said facilities and with portions of the side surfaces of the terminals adjacent the end surfaces extending through and being held in clamped engagement by portions of the supporting facilities to prevent unintended pivotal movement of the terminal, the supporting facilities capable of having other portions thereof displaced upon insertion forces being applied to the terminal subsequent to insertion of a conductor into the cavity to permit the terminal to be moved further into the opening to embed the barbs in the material defining the slot and seat fully the terminal within the housing. The displacement of portions of the supporting facilities causes portions of the supporting facilities adjacent the displaced portions to be in clamping engagement with the side surfaces of the terminal, the clamping engagement of the supporting facilities with the terminal and the embedding of the barbs in the material defining the slot cooperating to stabilize the terminal and prevent unintended lateral and longitudinal, as well as linear, movements thereof.

BRIEF DESCRIPTION OF THE DRAWINGS

Other features of the present invention will be readily understood from the following detailed description of specific embodiments thereof when read in conjunction with the accompanying drawings, in which.

DETAILED DESCRIPTION

Overall

Figure 1:
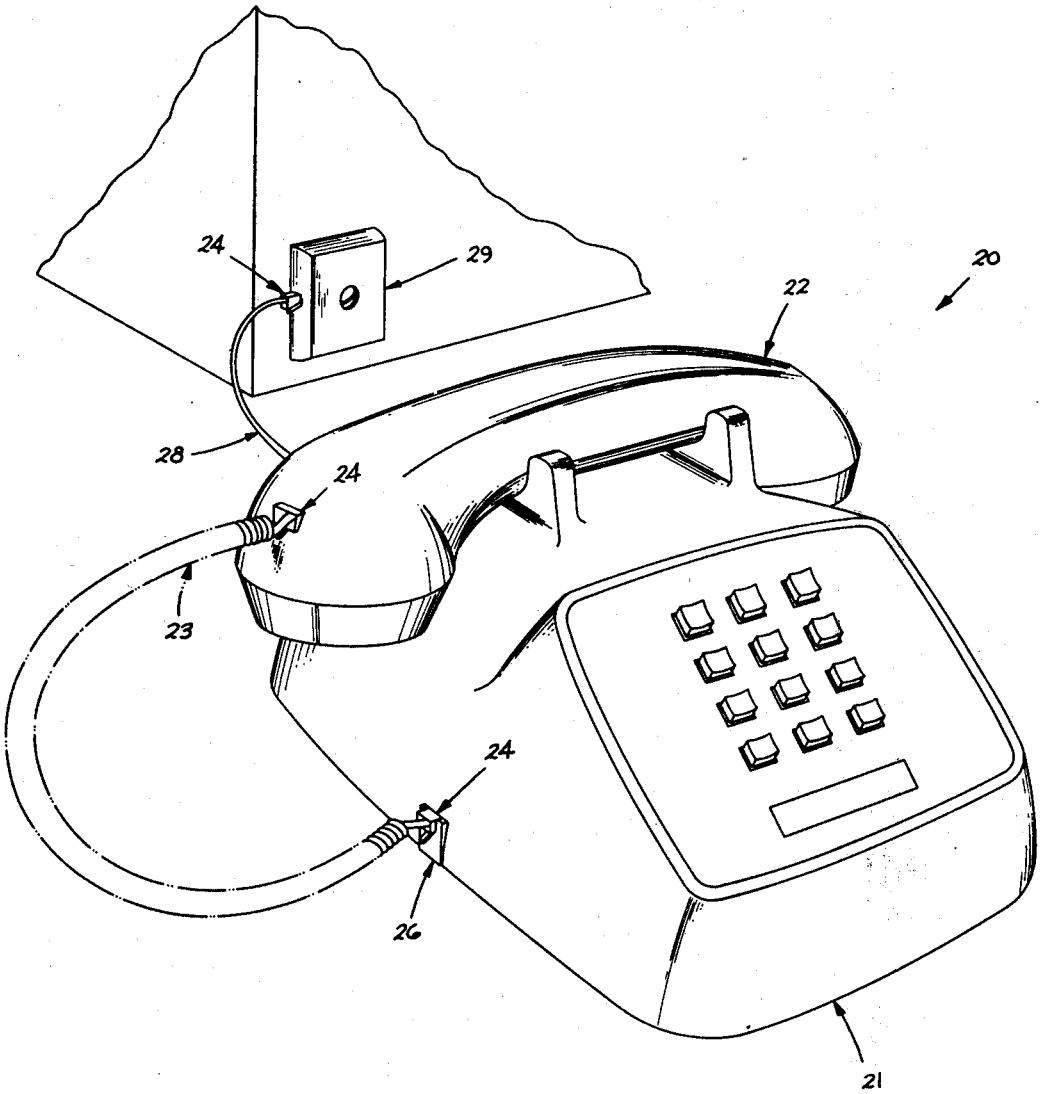
FIG. 1 is a perspective view showing plugs which embody the principles of this invention inserted into a handset and base portion of a telephone set and into a wall terminal block.

Referring now to FIG. 1, there is shown a telephone designated generally by the numeral 20, which includes a base portion, designated generally by the numeral 21, and a handset portion, designated generally by the numeral 22. A retractile cord, designated generally by the numeral 23, interconnects the base portion 21 and the handset portion 22.

Each end of the retractile cord 23 is provided with a plug, designated generally by the numeral 24, designated to be inserted into a jack 26. One of the plugs 24—24 is inserted into one of the jacks 26—26 assembled to the handset end and the other plug of the retractile cord 23 inserted into a jack in the base 21 of the telephone 20. The plug 24 has facilities for establishing electrical connections between the cord 23 and internal contacting components 27—27 of the telephone 20 (see FIG. 17). Ones of the plugs 24—24 are also assembled to each end of a line cord, designated generally by the numeral 28 (see FIG. 1), for connecting the line cord to jacks 26—26 in the telephone base 21 and in a wall terminal block 29.

Figure 8:
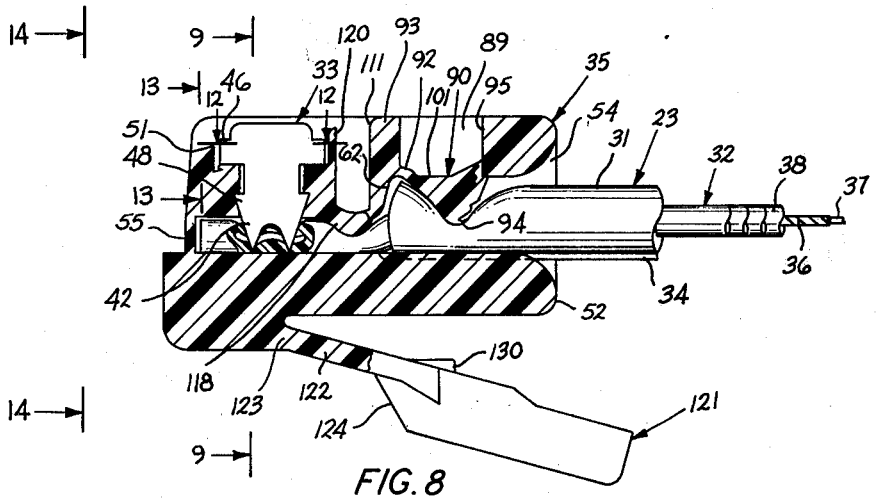
FIG. 8 is an elevational view partially in section subsequent to the assembly of the cord and the plug of FIG. 6 showing the jacket strain-relief member of the plug after having been moved into engagement with the jacket of the cord to provide strain relief for the cord and a portion of the housing having been reformed into a strain-relief member in engagement with the conductors and also showing the terminals fully seated within the housing.

Referring now to FIG. 8, a more detailed view of the structure of the retractile cord 23 can be seen. The retractile cord 23 includes a jacket 31 which covers a plurality of insulated conductors 32—32 and which has a ridge 34 formed longitudinally thereof. A free end portion of each of the conductors 32—32 is designed to be connected to an associated one of a plurality of terminals, designated generally by the numerals 33—33 (see FIG. 2) which are supported in a dielectric housing, designated generally by the numeral 35. Each of the conductors 32—32 is constructed of a nylon core 37 with a tinsel ribbon 36 wrapped helically thereabout. The tinsel ribbon 36 has an insulation covering 38 extruded thereabout. The outside nominal diameter of the individual insulated conductors 32—32 is approximately 0.037 inch.

Miniature plugs constructed in accordance with the present invention permit the assembly of the cord ends to the dielectric housing of the plugs and then the expeditious seating of factory-assembled partially seated terminal blades in the housing. This avoids undue handling of the miniature blades in the field and the necessity for expensive equipment to form the terminals and to assemble them with the dielectric portion of the plug.

Terminals

The terminals 33—33 (see FIGS. 2, 7 and 8) provide the connection between the conductors 32—32 of the cord 23 and the external components in the telephone base 21, for example. In a manufacturing environment, the terminals 33—33 are formed and then inserted into an already assembled cord and plug in an apparatus, for example, as disclosed in U.S. Pat. No. 3,839,787 issued October, 1974 in the names of W. B. Brown (now deceased) and F. D. Gavin. In the alternative, cord ends may be inserted into an apparatus disclosed in U.S. Pat. No. 3,895,434 issued July 27, 1975 in the names of G. P. Adams, F. D. Gavin, Jr. and A. P. Natale in which plugs are assembled about the cord ends and terminals 33—33 formed and inserted.

Each one of the terminals 33—33 (see FIG. 2) is made from a flat strip of an electrically conductive resilient material such as, for example, Phosphor bronze. The terminal 33 has a flat portion or side surface 41 with at least one contact or insulation-piercing tang 42 protruding therefrom. The tangs 42—42 provide electrical connection between the conductive portion of the conductor 32—32 and the associated ones of the terminals 33—33.

Each of the flat or blade-like terminals 33—33 also has an edge surface 43 having curved crowns 44—44 of predetermined radii. The crown 44 nearest a free end of the housing 35 functions to complete the connection between the associated conductor 32 and an associated external-contacting component 27 illustrated in FIG. 17, and positioned in the telephone jack 26. The edge surface 43 is plated with a corrosion-resistant metal, e.g., gold.

Provisions are also made for seating properly the terminals 33—33 within the housing 35. Each of two opposed end surfaces of the terminals 33 is formed with shoulders 46—46 having necked-down portions 47—47 that terminate in barbs 48—48. When the terminal 33 is inserted into the housing 35, the barbs 48—48 penetrate the dielectric material to anchor the terminal.

The ability of an electric connecting device to function within the framework of miniature dimensions alloted thereto within the confines of the telephone is an important feature of the mini-plug 24 which embodies the principles of this invention. For, example, the terminals 33—33 are punched from sheet stock having a thickness of $0.012 \pm 0.001$ inch. Each terminal 33 has an overall height of 0.169 inch from the edge surface 43 to the tips of the tangs 42—42 and an overall length of $0.134 \pm 0.006$ inch.

It should be apparent that the size of the terminals 33—33 and attendant fragility precludes the use of, for example, pliers or other techniques used in prior art preassembled connectors, e.g., see U.S. Pat. No. 3,812,449, to make the final assembly. Moreover, the need to preserve the corrosion-resistant covering along the edge surface 43 has brought on the use of blade insertion rams in U.S. Pat. Nos. 3,839,787 and 3,895,434, having polished contact surfaces.

Figure 2:
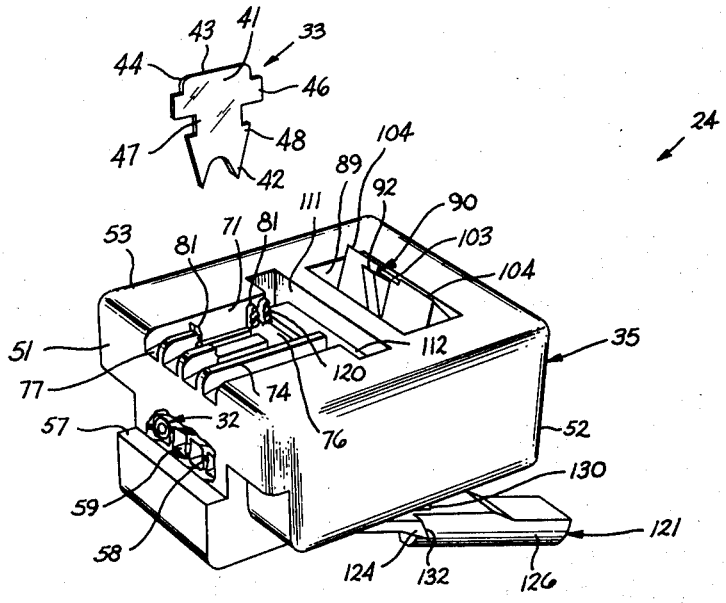
FIG. 2 is a perspective view of one of the plugs of the preferred embodiment comprising an unipartite housing prior to assembly of a cord and terminals therewith for purposes of clarity and further showing an internally moveable jacket strain-relief member of the plug prior to movement thereof.

It should be observed from FIG. 2 and from U.S. Pat. No. 3,860,316, for example, that the terminals 33—33 are aligned axially, as opposed to transversely, of the associated ones of the conductors 32—32. Prior art partially assembled connectors (U.S. Pat. Nos. 3,812,449 and 3,890,029) which includes terminals having slots for receiving the conductors would tend to compress the tinsel conductors within the slots and electrical contact is less than certain. The requirement of point electrical contact by the tangs 42—42 imposes different design criteria on the housing 35 insofar as the support of the terminals in both the temporary and final position thereof.

Dielectric Portion-Preferred Embodiment

Figure 4:
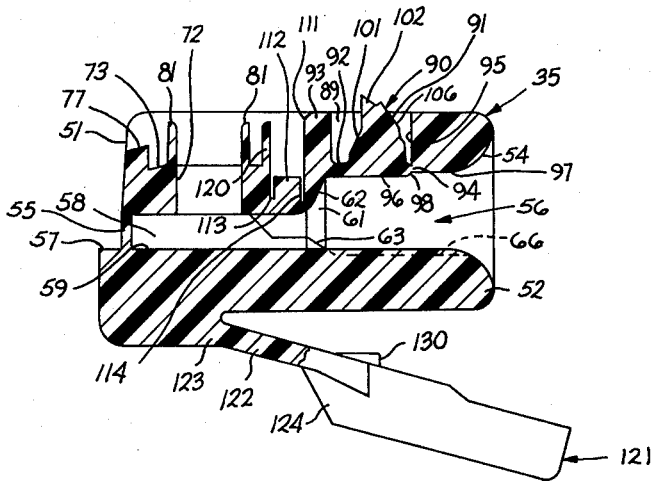
FIG. 4 is an elevational view of a housing of the plug of FIG. 2 partially in section prior to the assembly of the terminals therewith.
Figure 5:
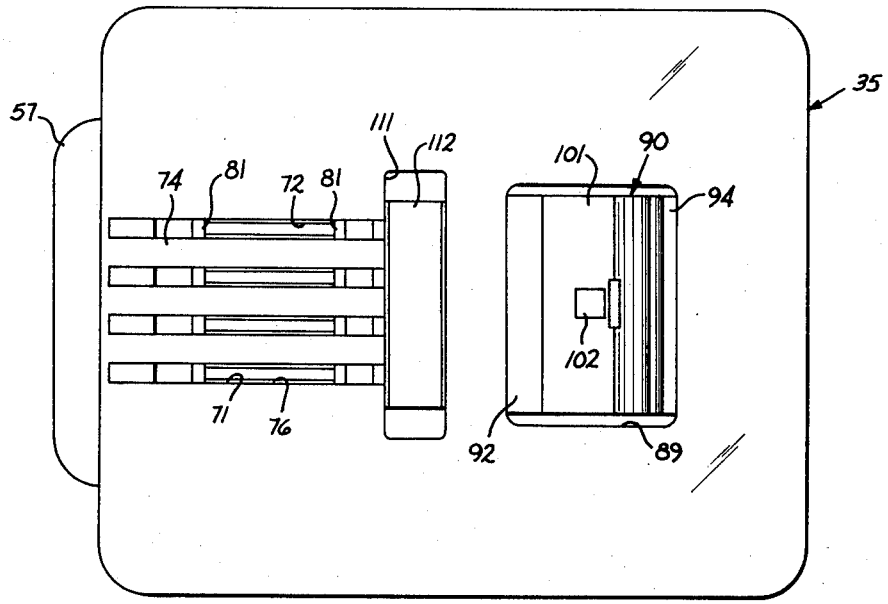
FIG. 5 is a plan view of the housing of FIG. 2 prior to assembly of the terminals therewith.
Figure 7:
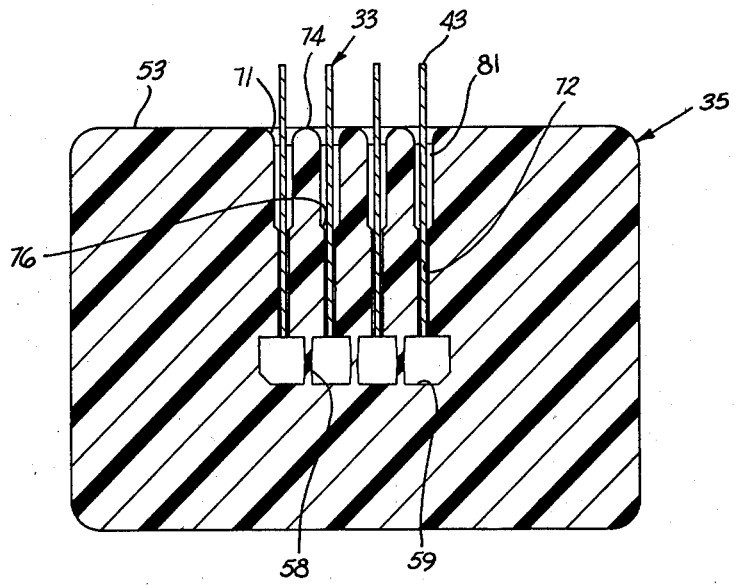
FIG. 7 is an enlarged sectional view taken along lines 7—7 of FIG. 6.

The terminals 33—33 are partially assembled in a manufacturing environment to ones of the plugs 24—24 and shipped, for example, to field personnel for assembly to cords and final seating of the terminals. The detailed construction of a preferred embodiment of the housing 35 of a plug 24 is best shown in FIGS. 4, 5 and 7. The preferred housing which is a rigid, dielectric unipartite housing, is designed to be easily molded by using conventional injection molding techniques. The housing 35 may be made of materials, such as, for example, polycarbonate, polyamide, polystyrene, polyterephthalate, or polyester elastomers or related polymers such as ABS resin, or glass-filled mixtures thereof, all of which provide suitable mechanical strength and rigidity as well as adequate electrical insulation. The rigid, dielectric housing 35 has a free end 51, a cord-input end 52, and a terminal-receiving surface 53. The advantages, as well as other features, of an unipartite housing 35 constructed in accordance with the principles of this invention are set forth in U.S. Pat. No. 3,860,316, which is incorporated by reference hereinto.

Figure 6:
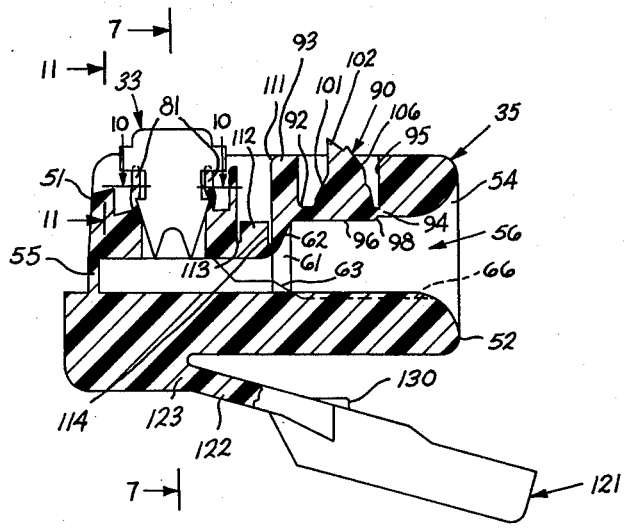
FIG. 6 is an elevational view of the housing shown in FIG. 4 with terminal blades assembled partially thereto.

It may be observed from FIGS. 4 and 6 that the housing 35 includes a cord-input aperture 54 which is defined by the housing as molded and which circumscribes substantially the portion of the jacket 31 of the cord 23 extending therethrough. As may be appreciated from the drawing, the housing 35 is constructed in one piece with the cord-input aperture 54 formed entirely therewithin. The aperture 54 has a flared entrance which prevents sharp bends in the cord 23 about an otherwise sharp edge during use of the telephone 10 by the subscriber. This advantageously increases the life of the cord 23. The flared entrance also facilitates insertion of a leading end of the cord 23.

The cord input aperture 54 opens to a cavity 56 (see FIG. 4) which substantially encloses the entire end section of the cord which is inserted into the aperture 54. In a preferred embodiment, the cavity 56 terminates in a wall 55 adjacent a ledge 57 at the free end 51 of the base of the housing 35. In an alternate embodiment (see, for example, FIG. 17) the cavity 56 opens to the ledge 57 which is used as an anvil for conductor cut-off. Since in the preferred embodiment, the end wall 55 precludes the use of the ledge 57 as an anvil for conductor cut off, the cord end must be stripped with some precision insofar as the length of jacket removed prior to insertion into the plug 24.

The housing 35 is also constructed with conductor-receiving facilities. The conductor-receiving facilities are dimensioned so that the conductor 32 therein cannot move laterally. This is necessary to insure that during the insertion of the terminals 33—33, the terminals remain aligned with the conductors 32—32 to make electrical engagement therewith. These provisions include a plurality of longitudinally extending partitions 58—58 of the configuration best seen in FIG. 7, for example, with approximately 0.038 inch clearance therebetween. The partitions 58—58 form effectively a plurality of conductor-receiving troughs 59—59 therebetween.

In the preferred embodiment, the housing 35 is constructed to prevent a dielectric breakdown between adjacent ones of the conductors 32—32. Such a breakdown may occur, for example, because of the ingress of moisture or other corrosive contaminants and because of shortened dielectric paths between adjacent ones of the conductors 32—32.

These provisions include molding of the housing 35 such that cavity 56 is closed off at the free end 51 thereof (see FIG. 4) with the wall 55. The configuration of the troughs 59—59 shown in FIG. 7 increases the dielectric path between conductors and reduces substantially the probability of breakdown. The partitions 58—58 are constructed to extend from the bottom of the troughs 59—59 to the top of the cavity 56 to compartmentalize effectively the conductor 32—32.

The construction of the partitions 58—58 as shown in FIG. 7, causes the center lines of the troughs 59—59 formed therebetween to be misaligned slightly with the center lines of the terminal-receiving openings. Hence, the longitudinal axes of the conductors 32—32 received within the troughs 59—59 will not be aligned precisely within the terminal-receiving blades 33—33. For example, the longitudinal center line of each of the troughs 59—59 adjacent the longitudinal center line of the housing 35 is approximately 0.002 inch out of alignment with the associated terminal blades 33—33 which are on 0.040 inch spacing. The outermost blades 33—33 may be misaligned approximately 0.006 inch from their associated conductors 32—32. This does not affect adversely the electrical engagement of the tangs 42—42 with the tinsel ribbon 36 which may be affected slightly off center of the conductor as well as along the center line because of the helical wrapping of the tinsel conductor 32 about the core 37.

Figure 14:
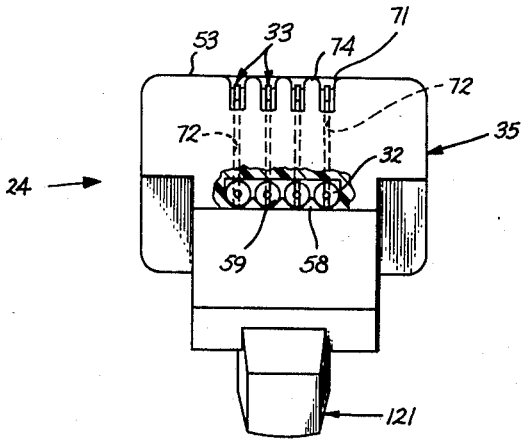
FIG. 14 is a front end view of the plug shown in FIG. 8, partly broken away and taken along lines 14—14 thereof and showing an alternate embodiment of conductor receiving facilities.

As can best be seen in FIG. 14, the cavity 56 in an alternative embodiment may be formed with a plurality of longitudinally extending partitions 58—58 which are molded with the dielectric housing 35 in the form of toothed ridges with a plurality of flat-bottom conductor-receiving troughs 59—59 formed therebetween on 0.040 inch centers and opening to the free end 51.

The troughs 59—59 in FIG. 14 are constructed advantageously with flat bottom portions approximately 0.018 inch in width. These provide a bearing surface against which the terminals 33—33 may be driven and provides substantial support for the associated conductors 32—32 to avoid undue lateral displacement and distortion thereof during terminal insertion. Moreover, it is desired that the tangs 42—42 of the inserted terminals 33—33 extend through the associated conductors 32—32 and become embedded in the trough bottoms. If the troughs 59—59 were constructed with V-shaped bottom portions as opposed to the flat configurations, the embedding of the tangs 42—42 may be extremely difficult because of increased centerline depth, for example.

The embodiment shown in FIG. 14 is constructed with the cavity 56 closed off from the ledge 57 by the wall 55. In that event, it is contemplated that the particles 58—58 would be connected integrally with the wall 55. Moreover, the wall 55 is constructed to have the troughs 59–59 extend thereinto. In that way, the ends of the conductors 32—32 are received within the openings in the wall 55 and the possible inadvertent crossover of a conductor from its associated trough into another is prevented.

Figure 17:
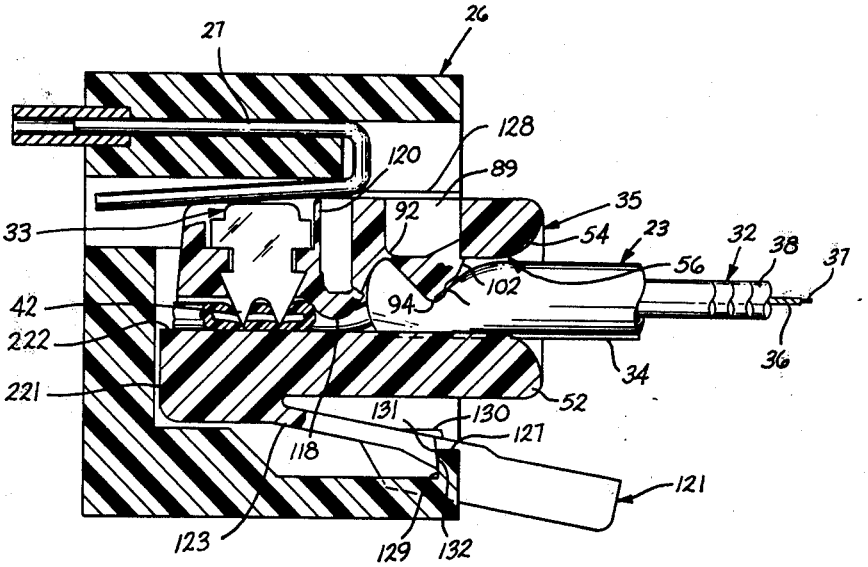
FIG. 17 is an elevational view partially in section and showing the plug of FIG. 8 inserted into a jack in a telephone set.

As can be observed from FIG. 4, the bottoms of the troughs 59—59 there are substantially coplanar with the top ledge 57 at the free end 51. This facilitates the use of the ledge 57 at the free end 51 as an anvil for conductor cut-off during assembly of the plug 24 to the cord 23 should the plug housing 35 be constructed without the end wall as shown in FIG. 17.

As can best be seen in FIG. 4, the portion of the cavity 56 adjacent the cord-input end 52 communicates with the main portions of the conductor-receiving troughs 59—59 through a tapered transition section 61 having a shoulder 62. The partitions 58—58 are constructed to extend along a sloping face 63 of the tapered transition section 61.

In assembling the plug 24 to the cord 23, a portion of the cord jacket 31 is stripped to expose a predetermined length of each of the insulated conductors 32—32. The cord 23 is inserted into the input aperture 54 until the conductors 32—32 are moved along associated ones of the conductor-receiving troughs 59—59 extending down the sloping face 63.

The portions of the partitions 58—58 extending down the sloping face 63 assist in separating and guiding the conductors 32—32 into the main portions of the associated ones of the troughs 59—59. In order to accomplish the separation of the conductors 32—32, the end portions of the partitions 58—58 facing into the cavity 56 are feathered to present an edge to the inserted cord 23.

As the conductors 32—32 are moved up the face 63, the jacketed portion of the cord 23 is being moved into the cavity 56. When the cord 23 has been advanced such that the conductors 32—32 are received in the troughs 59—59, the leading end of the jacket 31 is in engagement with the shoulder 62 (see FIG. 8).

Also, as can be seen in FIG. 4, the walls of the cavity 56 are formed to include a groove 66 longitudinally thereof. The groove 66 is designed to mate with cords having the ridge 38 formed externally of the jacket to insure that the cord 23 is inserted into the plug 24 such that the conductors 32—32 are properly oriented with respect to the jack 26 when the plug 24 is inserted thereinto.

As can best be seen in FIGS. 2, 4 and 7, the housing 35 is formed with a well 71 having a plurality of spaced parallel terminal-receiving openings 72—72 opening thereto. The openings 72—72 are in the form of slots and are parallel with and aligned on a one-to-one basis with associated ones of the conductor-receiving troughs 59—59. Each of the slots 72—72 is of a length slightly less than the overall length of that portion of the terminal 33 which is to be received therein. The shortening of the slots 72—72 from the overall length of the well 71 forms abutments 73—73 (see FIG. 4, for example).

Figure 3:
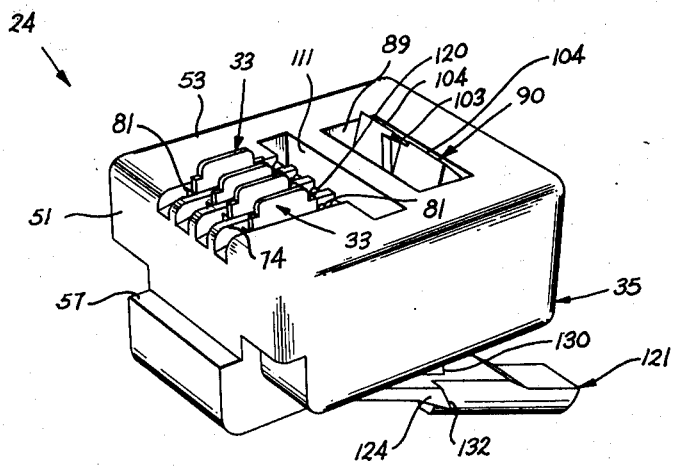
FIG. 3 is a view of the plug shown in FIG. 2 with terminals partially inserted thereinto.

The dielectric housing 35 is also formed with a plurality of fins 74—74 (see FIGS. 2, 3 and 5). The fins 74—74 are upstanding from a bottom surface 76 of the well 71 to which the terminal-receiving slots 72—72 open and are spaced on centers of approximately 0.040 inch. Also, the fins 74—74 are aligned between adjacent associated ones of the terminal-receiving slots 72—72. In this way, the external contacting components 27—27 of the jack 26 are received between the associated fins 74—74 and guided into engagement with portions of the terminals 33—33.

Prior to the insertion of the plug 24 into the jack 26, free end portions of the external contacting portions 27—27 extend at an angle in the range of 30° to 45° to the horizontal as viewed in FIG. 17. Advantageously, upon insertion of the plug 24 into the jack 26, the initial deflection of the free end portions of the contacting portions 27—27 is accomplished by their engagement with associated ones of a plurality of wire-lifters 77—77 (see FIGS. 2 and 4) formed integrally with the housing 35.

The burden of initially deflecting the contacting portions 27—27 is borne by dielectric material of the housing thereby avoiding abrasion of the surfaces of the contacting portions with the associated terminals. This extends the life of the terminals 33—33 and preserves the integrity of the contacting surfaces for engagement in the operative position.

The dielectric housing 35 advantageously has a plurality of webs 81—81 (see FIGS. 2, 4 and 5) spanning transversely between and molded integrally with adjacent ones of the fins 74—74. Each of the webs 81—81 has a thickness of about 0.007 inch and a height of about 0.058 inch, the top of each web being spaced about 0.025 inch from the surface 53 of the plug 24. As can best be seen in FIGS. 2 and 3, the webs 81—81 form effectively a plurality of compartments with which associated ones of the terminal-receiving slots 72—72 communicate.

The webs 81—81 serve to support the terminals 33—33 during shipment and handling until field personnel apply forces to the terminals intended to seat the terminals within the housing 35. The webs 81—81 may also be used to support the terinals 33—33 inserted to a first depth at one work station in a manufacturing enviornment for final assembly to a cord end at another work station.

In order to appreciate the complexity of the problem of providing a prefabricated plug 24, attention is directed to the dimensions thereof. The plug housing 35 is constructed such that the clearance laterally between the fins 74—74 is 0.022 ± 0.002 inch in order to receive the wire-like terminal of jack 26 into which the plug is inserted. The wire typically has a diameter of 0.019 inch. The terminal-receiving slot 72 has a thickness of 0.015 ± 0.001 inch.

It would be possible than to have a 0.013 inch thick blade terminal 33 for insertion into a 0.014 inch thick opening. If the blade terminal 33 was manufactured for an interference fit along the flat faces thereof, unduly high forces would have to be applied thereto. The thickness of the blade terminal 33, e.g., 0.012 inch as opposed to, for example, 0.036 inch in U.S. Pat. No. 3,812,449 mitigates against the use of such mutilating forces.

The webs 81—81 are constructed to engage portions of the terminals both in the partially seated and fully seated position. While in the preferred embodiment to be described hereinafter, overhanging portions of the terminals 33—33 extend through the associated webs, it is within the scope of this invention to have end portions of the terminals deform and become embedded in the webs.

By using the principles of this invention, the terminals 33—33 gouge out a controlled amount of material. The employment of the webs 81—81 provide adequate material for embedment of the barbs 48 well within tolerance ranges of the terminal 33 and of the molded housing 35.

The use of the webs 81—81 not only holds the terminals 33—33 securely to the housing 35 prior to seating of the terminals by field personnel but also advantageously prevents unintended pivotal movement of the terminals while supported in the temporary or first position as shown in FIG. 6. The housing 35 is designed so that the tops of the troughs 59—59 are about 0.140 inch below the surface 53 of the plug housing 35. Since the overall terminal height is 0.169 inch, approximately 0.029 inch of each terminal is free-standing above the housing 35 when the terminals are in their partially seated position. Also recalling that only 0.058 inch of the terminals 33 is received in the narrow, e.g., 0.014 inch portion of the opening, 0.111 inch of the terminal is unsupported. Hence, when insertion forces are applied in the field, the terminal 33 would tend to pivot laterally about the top of the narrow portion of the terminal-receiving opening 72 in the event that the webs 81—81 were not used. This would be unacceptable and result in deformed terminal blades.

The use of the webs 81—81 advantageously moves the pivot point of the blades upwardly substantially. For example, the barbs 48—48 are designed to become embedded in the walls at a point 0.071 inch above the tops of the troughs 59—59.

Figure 10:
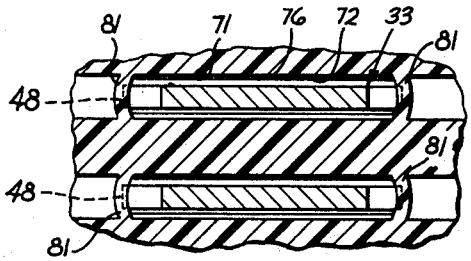
FIGS. 10 and 11 are plan and end detail views partially in section of portions of the plug taken along lines 10—10 and 11—11 in FIG. 6 and showing the terminals partially inserted into the housing.
Figure 11:
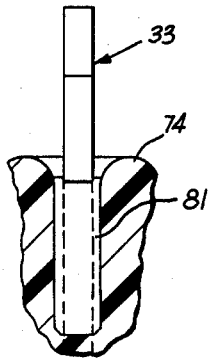

Also, since the webs 81—81 extend to within 0.025 inch of the surface 53 of the plug 24, the shoulders 46—46 of the partially inserted terminals shown in FIG. 6 have sheared through portions of the webs. As can best be seen in FIGS. 10 and 11, the partial insertion of the terminals 33—33 causes each of the webs 81—81 to become arched laterally toward the free end 51 of the housing and toward the cord-input end 52. This enhances the stability of each of the terminals 33—33 as the portion of the webs 81—81 adjacent the terminals have a memory spring-back into pinching engagement with the flat side portions 41—41 of the terminals.

This reduces substantially the free standing portion of the terminals 33—33. Moreover, the use of the webs 81—81 creates a two point control of each of the terminals 33—33. Not only is there a clamping engagement of arched portions of the webs 81—81 with the flat sides 41—41 of the terminals 33—33 (see FIG. 6), but there is also an embedment of the barbs 48—48 into innermost portions of the webs. This reduces greatly the possibility of an insertion tool sliding off the top edge surface 43 of each terminal. Slide-off is engendered by the requirement of only a 0.019 inch wide tool because of the necessity of entering the possibly 0.020 inch terminal-receiving opening between the fins 74—74.

Figure 9:
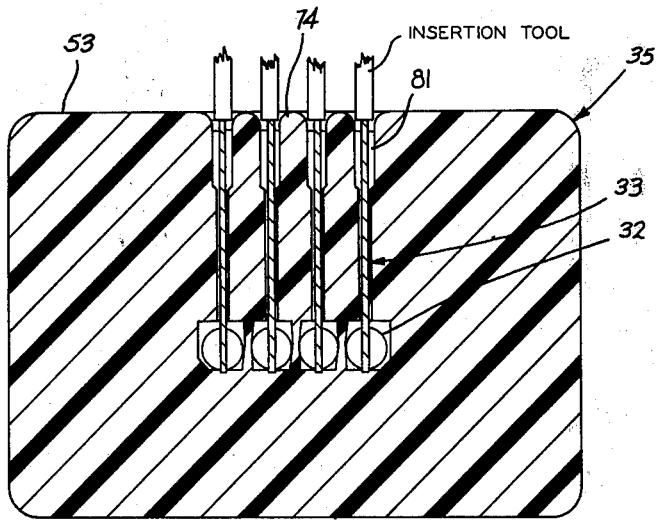
FIG. 9 is an enlarged sectional view taken along lines 9—9 of FIG. 8 and showing the terminals fully seated within the housing.

The design of the webs 81—81 must be such as to not effect adversely the extent to which the terinal 33 is inserted into the associated terminal-receiving slot 72. The seating of the terminals 33—33 is important to insure that adequate electrical engagement is effected between the terminal tangs 42—42 and the conductors 32—32. If the depth of insertion if lacking, the tangs 42—42 may not engage one or both aligned portions of the helical tinsel ribbon 36. On the other hand, if the depth of insertion is too great, the shoulders 46—46 could rupture the abutments 73—73. It is important that the tangs 42—42 engage the top or closest portion of the tinsel ribbon 36, be moved through the core 37, and the bottom portion of the helically wrapped tinsel ribbon 36 and into engagement with the flat bottom portions of the troughs 59—59 (see FIGS. 8 and 9).

The seating of the terminals 33—33 within the housing 35 is also important with respect to the engagement of the jack components 27—27 therewith. Overseating could detract from adequate electrical engagement of the terminals 33—33 with the components 27—27 while underseating could raise unduly the crowns 43—43 above their associated compartments and possibly cause ones of the wire-like components 27—27 to crossover undesirably ones of the fins 74—74.

When the terminals 33—33 are fully seated (see FIG. 8), the barbs 48—48 become embedded in the walls of the slots 72—72 and the shoulders 46—46 tear or slice further through associated ones of the webs 81—81. Further arching of the webs 81—81 occurs and additional portions of the flat surfaces 41—41 of the terminals are clamped by the torn or sheared edges of the webs. The result is an excellent seating of the terminals 33—33 within the housing which resists unintentional, longitudinal or lateral turning, as well as any linear movements of the terminals.

The housing 35 is constructed with facilities capable of being operated subsequent to insertion of an end portion of the cord 23, but prior to or simultaneously with the seating of the terminals 33—33, for providing strain relief for the jacket and for the individual conductors 32—32. These are disclosed in commonly assigned applicaton, Ser. No. 620,630 filed of even date herewith in the name of E. C. Hardesty.

Figure 15:
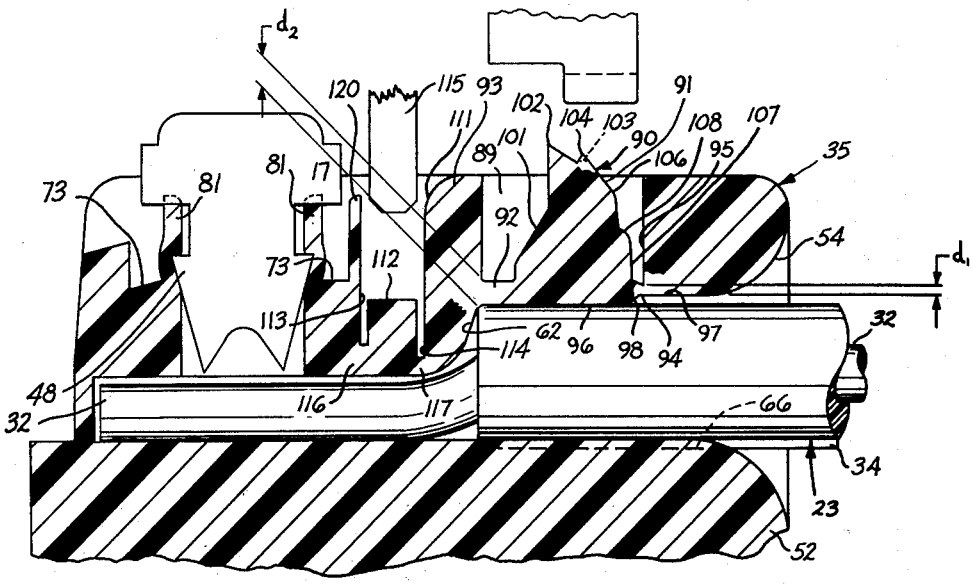
FIGS. 15 and 16 are enlarged detail views in elevation showing the terminals partially and fully seated, respectively, in the unipartite housing with the cord present.
Figure 16:
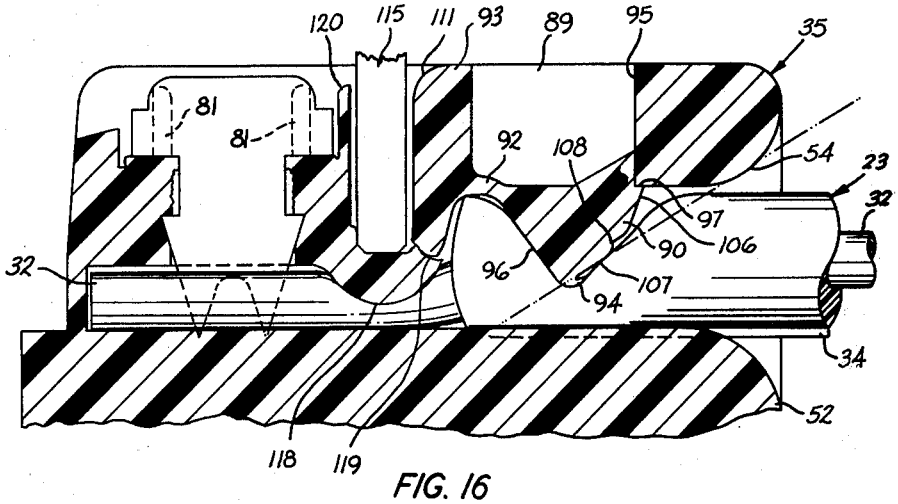

As can best be seen in FIGS. 2, 15 and 16, the housing 35 is constructed with an opening 89. A jacket-anchoring member 90 with an initially external facing portion 91 is disposed within the opening 89 and is connected to the plug 24 through a plastic hinge 92 oriented toward the free end 51 of the housing 35 and extending from a wall 93.

The member 90 is also connected to the housing 35 toward the cord-input end 52 thereof by a frangible portion 94 of dielectric material. The frangible portion 94 supports the anchoring member 90 in its initial position to facilitate insertion of an end portion of a cord 23 into the cavity 56. As can best be seen in FIG. 15, the frangible portion 94 is constructed such that the dimension $d_1$, adjacent a wall 95 is substantially less than the dimension $d_2$ of the hinge 92 adjacent the wall 93. Further, the frangible portion 94 is constructed so that the thickness thereof adjacent the main portion of the anchoring member 90 is greater than the dimension $d_1$. This controls the separation of the member 90 from the housing 35 to be adjacent the cord-input end 52 so that the member 90 may be moved pivotally about the hinge 92 to engage the cord jacket 31.

The anchoring member 90 includes a surface 96 which protrudes slightly, e.g., 0.005 inch into the cavity 56 beyond an adjacent surface 97 of the remainder of the housing adjacent the cord-input aperture 54. The frangible portion 94 is connected to the surface 96 by a step 98 (FIG. 15). When the anchoring member 90 is actuated, the frangible portion 94 together with the adjacent portion of the surface 96 forms a tapered trailing edge (see FIG. 16) rounded generally with the contour of the cord 23 as it is moved into clamping engagement with the cord. Since this is the portion that is most deeply embedded into the cord, it is most advantageous that there are no sharp burrs or edges opposed to the direction of pulling forces to tear the material comprising the jacket 32 during customer use.

The pivotal movement of the anchoring member 90 causes the originally external facing portion 91 to be moved forcefully along the side of a wall 95 which defines partially the opening 89 and then to latch a minimum distance of 0.008 inch under a lip formed by a portion of the surface 97 (see FIG. 16). There is some compression of the portion 91 during this movement bur once it is moved out of engagement with the side wall of the opening 89, its elastic memory properties facilitate a springback to its initial configuration with an accompanying catching, e.g., about 0.008 inch, under the lip surface 97.

The anchoring member 90 also has a second externally facing surface 101, angularly disposed to the surface 91, and having a stop 102 formed centrally thereof (see FIG. 15). As disclosed in copending commonly assigned application, Ser. No. 620,630 filed of even date herewith, the stop 102 engages the the surface 95 to prevent overtravel of the anchoring member 90 when moved to engage the cord 23 thereby preventing excessive distortion of the cord. The stop 102 and the lip 97 cooperate to positively hold the anchoring member 90 in engagement with the housing 35 and the cord 23 (see FIG. 16) when retrograde forces are applied to the cord by the customer during use.

Preferably, the edge of the intersecting surfaces 91 and 101 aligned with the stop 102 is formed with a chamfer 103 (see FIGS. 2 and 15). In this way, a latching arrangement is formed with the stop 102 interposed between portions 104—104 which engage with the lip surface 97 thereby stabilizing the stop therebetween when subjected to pulling forces during customer use.

As can be seen in FIG. 15, the anchoring member 90 is formed with two surfaces 106 and 107 connected by a step 108. The configuration is such that when the anchoring member is moved into the actuated position, the surface 107 is aligned with a tangent to a portion of the cord-input aperture 54 (see FIG. 16). This further provides continuous engagement with the cord 23 when the cord is flexed toward the plug surface 53. This acts to relieve excess stresses in the vicinity of the web 94.

The housing 35 is also formed with facilities to provide strain relief for the conductors 32—32. An opening 111 (see FIGS. 2 and 15) extends transversely across a portion of the housing 35. A conductor-anchoring member in the form of a restraining bar 112 of dielectric material spans the opening with the ends of the bar spaced from end walls of the opening 111. A portion of the bar 112 is spaced from the housing 35 by slots 113 and 114. The restraining bar 112 is integral with the walls of the opening 111 through connecting portions 116 and 117.

The restraining bar 112 is caused to reform in a particular way. The slot 114 is substantially longer than the slot 113 so that under application of forces by a specially adapted tool 115 (see FIG. 15), the bar is upset and reforms within the opening 111 to provide a generally headed strain relief element 118 (see FIG. 16) in engagement with ones of the individual conductor 32—32. A portion of the wall adjacent the deeper slot 114 is broken apart from the housing 35 along a line of fracture 119 and engages under the wall of the opening 111 to lock the element in engagement with the conductors 32—32 and with the housing 35 (compare FIGS. 15 and 16).

This arrangement functions surprisingly well in a somewhat similar fashion to the anchoring member 90. Space limitations do not permit the use of another anchoring member 90 for restraining the conductors 32—32. However, the novel arrangement of the slots 113 and 114 causes a compression of and reconfiguring of the bar 112 under a 40,000 lbs./sq. inch pressure of the tool 115. A line of fracture 119 occurs to permit a reflow of the plastic material to anchor under the wall 93. Surprisingly, the effect of the bar 112 is similar to the pivotal motion of the member 90 and the accompanying latching arrangement thereof.

The molding of the housing 35 with the above-described ability to be able to precisely confine the conductors 32—32 in the troughs 59–59 is especially important. Prohibition against movement is necessary in order to cause the terminals 33—33 to be inserted with sufficiently high forces imparted thereto to penetrate the insulation. If the conductors 32—32 were free to move laterally of the plug, the conductors would move on either side of the conductive elements and fail to establish engagement therewith.

As can best be seen in FIG. 4, the housing 35 is also constructed with a wall 120 spanning the well 71 adjacent the portion of the opening 111 oriented toward the cord-input end of the housing. The wall 120 is of assistance in preventing lateral buckling of the housing 35 during the use of the tool 115 to reform the restraining bar 112.

Figure 18:
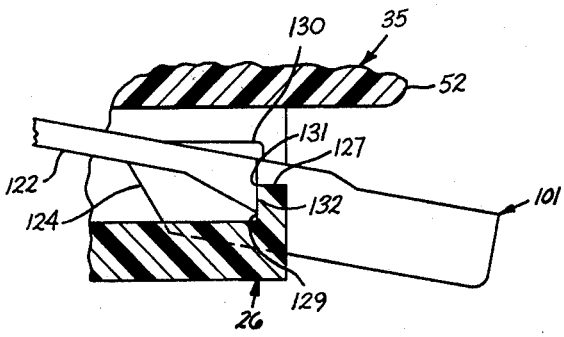
FIG. 18 is an enlarged view of a portion of the plug inserted into the telephone set, for example, and showing provisions for locking the plug thereinto.

Formed integrally with the dielectric housing 35 is a resilient locking tab, designated generally by the numeraly 121 (see FIGS. 2, 17 and 18). The locking tab 121 is approximately 0.049 inch thick, 0.200 inch wide, and 0.500 inch long. The locking tab 121 is molded with its longitudinal axis oriented at an angle approximately 15° to the terminal-inserting side 53 and with a generally flat portion 122 connected by a plastic hinge 123 to the free end 51 of the housing 35. The portion 122 is stepped to form wings 124—124 adjacent a subscriber-contact portion 126.

The combined height of the thickness of locking tab 121 and resiliency of the locking tab permits the insertion of the plug 24 into the jack 26 between opposing surfaces 127 and 128 (see FIGS. 17 and 18). The tab 121 can be deflected inwardly toward the dielectric housing 35 and be moved slideably in engagement with the surface 127 which forms an entrance ledge. The locking tab 121 also has a stop 130 formed on the inwardly facing side of the flat portion 122 to prevent an undue amount of deflection of the tab 121 which could destroy the hinge 123.

After being released, the locking tab will essentially resume its original molded shape and orientation because of its natural resilience. This causes the free end of the tab to be urged downwardly into seating engagement with surfaces of the jack 26 (see FIGS. 17 and 18) in the handset 22 and base 21.

The locking tab 121 is designed to lock the plug in the handset 22 and to prevent unintended removal thereof. A wall 129 and the ledge surface 127 cooperate to form an edge 131 which engages with the wings 124—124 of the locking tab 121. In order to accomplish this, the sloped portion of the tab 121 is constructed with shoulders 132—132 (see FIGS. 17 and 18). When the plug 24 has been inserted into the jack 26, the shoulders 132—132 engage the surface 129 of the jack 26.

In use, the terminals 33—33 are inserted partially into the plug 24 as described hereinbefore such that the crown portions 43—43 are exposed above the surface 53 of the plug (see FIG. 7). Then the partially assembled plug 24 may be moved to another station in a manufacturing environment for use in assembling new cords or to field personnel for refurbishing usage.

The webs 81—81 provide an unexpected advantage when used in a multistation assembly process in a manufacturing environment. As should be apparent from the foregoing description, the webs 81—81 provide support for the terminals 33—33 in a temporary position. Moreover, the webs 81—81 solve what had been somewhat of a manufacturing problem. Priorly, in the assembly of the terminals 33—33 to the housing 35, the terminals were moved along a guideway (not shown) by an insertion tool (not shown). There was a distance, albeit short, between the guideway and the portions of the plug which supported the terminal 33. At times, this permitted unwanted turning and misalignment of the miniature terminals 33—33. The construction of the housing 35 with the webs 81—81 reduces substantially this unsupported distance thereby precluding the opportunity for the terminal 33 to spin or turn and insures an essentially perfect insertion.

Subsequent to a partial insertion of the terminals 33—33, a cord end is inserted into the aperture 54 and into the cavity 56. The end portions of the cord 23 may be stripped to expose the individually insulated conductors 32—32 or may in other embodiments remain jacketed. In the former case, the conductors 32—32 are received in the associated troughs 59—59 whereafter the jacket anchoring member 90 and conductor restraining bar 112 are moved to an actuated position (see FIGS. 12 and 16).

Figure 12:
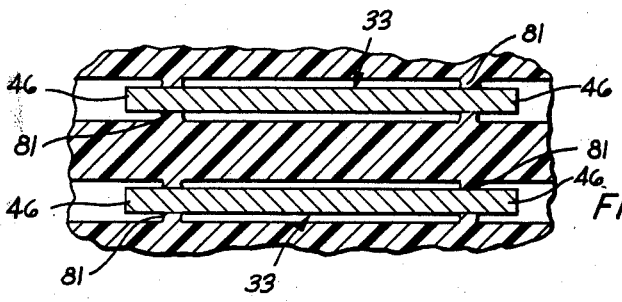
FIGS. 12 and 13 are plan and end detail views partially in section of portions of the plug taken along lines 12—12 and 13—13 in FIG. 8 and showing the terminals fully seated within the housing.

Subsequently or simultaneously with the operation of the strain-relief facilities, appropriate tooling is employed to move the terminals 33—33 to a fully seated position (see FIGS. 12 and 16). As this is accomplished, the barbs 48—48 become embedded in the walls of the slots 72—72 and the shoulders 46—46 slice further through associated ones of the webs (see FIGS. 12 and 13). The bi-directional arching of the webs 81—81 causes springback of the additional sheared-through portions of the webs 81—81 into clamping engagement with the shoulders 46—46 of the terminals 33—33 while the previously sheared surfaces of the webs grip other portions of the shoulders.

The overall result is an excellent seating of the terminals 33—33 in electrical engagement with the conductors 32—32 and with the tangs 42—42, the barbs 48—48 and the shoulders 46—46 embedded in and clamped by the dielectric material. This prevents unintended lateral and longitudinal movement as well as unintended pivotal motion caused, for example, by pulling forces applied to the cord 23.

The preferred embodiment of the housing 35 maximizes resistance to dust and moisture penetration and other contaminants and other attendant dielectric breakdown. The combination of the closed free end 51 and the full cavity height partitions 58—58 provide this result. The moisture and dust protection afforded by the housing 35 is also augmented unexpectedly by a still further function of the webs 81—81. Since the webs 81—81 extend to within 0.025 inch of the surface 53 and provide end compartmentalization of the terminals 33—33, the exposure of the terminals is essentially limited to the external contact surfaces 43—43.

Two Piece Housing

Figure 19:
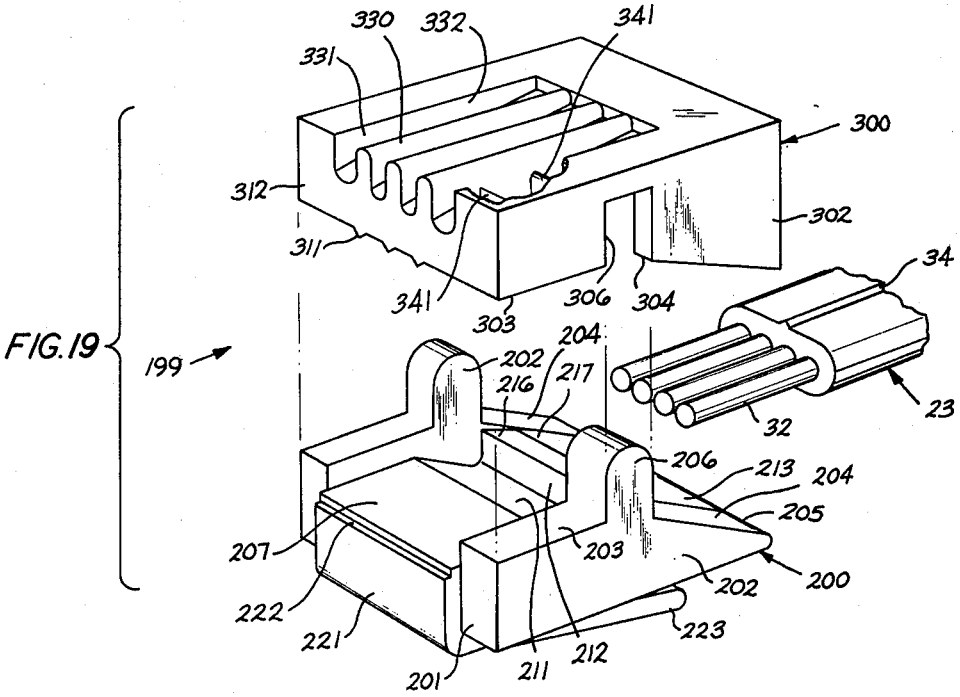
FIG. 19 is a perspective view of a two piece plug.

The principles of this invention are also applicable to a mini-plug 24 having a housing 199 (see FIG. 19) comprised of two parts bonded together, e.g., ultrasonically. Reference is made to U.S. Pat. No. 3,699,498 issued Oct. 17, 1972 and U.S. Pat. No. 3,761,869 issued Sept. 25, 1973 both in the names of E. C. Hardesty, C. L. Krumreich, A. E. Mulbarger, Jr. and S. W. Walden, both of which patents are incorporated by reference hereinto. Referring to FIG. 19 of the drawings, the plug 24 which is constructed in accordance with the principles of this invention is shown in a position to be inserted into the jack 26 (see U.S. Pat. No. 3,761,869) with which it mates.

As can best be seen in FIG. 19, the plug 24 includes a housing 199 that comprises mating parts that will be referred to as a base 200 and a cover 300. The base 200 and the cover 300 are molded, using conventional injection molding techniques, from a dielectric material such as polycarbonate molding compound.

Figure 20:
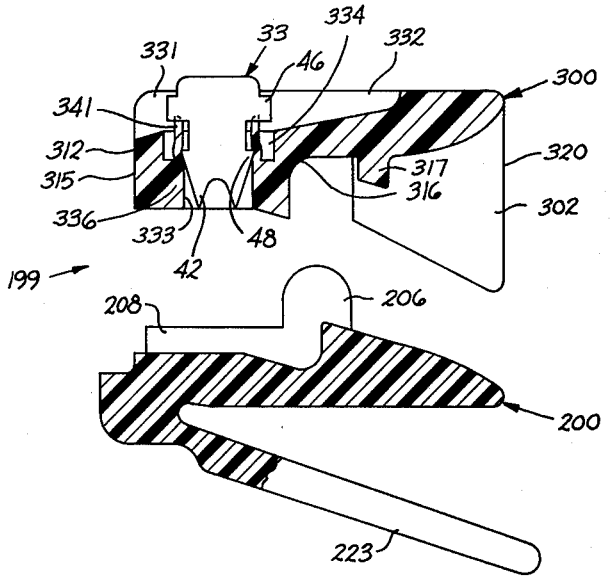
FIGS. 20 and 21 are enlarged views of portions of the plug of FIG. 19 showing the terminal blades partially and fully assembled to one of the parts, respectively.

As shown by reference to FIGS. 19 and 20, the base 200 has formed spaced side walls 202—202, each of which includes a horizontal mating surface 203 oriented to a free end 201 and an inclined mating surface 204 toward a cord-input end 205 with a tongue 206 interposed therebetween. Between the side walls 201, an interior surface 207 of the base 200 cooperates with the side walls to define a conductor-receiving cavity 208. The surface 207 includes inclined portion 211 oriented toward the cord-input end 205 of the base. The inclined portion 211 terminates in an upstanding protuberance 212 with a cord inlet portion 213 being situated between the protuberance and the cord-input end 205. The inlet portion 213 comprises a horizontal surface 216 joined to a convex surface 217 which curves continuously from the horizontal surface toward the cord-input end 205 of the base 200.

The base 200 is formed with a ledge 221 that protrudes from the free end 201 and includes a flat surface 222 that underlies the externally facing ends of the surface 207. A latch 223 extends from the ledge 221 and comprises an integral hinge portion 224 and includes additional portions for locking the housing 199 into a jack 27 as described in the patents incorporated by reference hereinto. The latch 223 normally extends at an angle to the underside of the base 200, but the hinge portion 224 permits it to be deflected toward the underside.

Turning again to both FIGS. 19 and 20, the cover 300 of the housing 199 has interior surfaces complementary to those of the base 200. The cover 300 has spaced side walls 302—302, each of which includes a horizontal mating surface 303 and an inclined mating surface 304 with a notch 306 interposed therebetween. The inclined mating surfaces 304—304 extend at the same angle as the inclined mating surfaces 204—204 of the base 200, while the notches 306—306 are of a size to accommodate the tongues 206—206. Consequently, the mating surfaces 203, 303, 204 and 304 cooperate with the tongues 206—206 and notches 306—306 to facilitate mating the cover 300 with the base 200.

The interior surface of the cover 300 between the side walls 302—302 includes spaced ridges 311—311. The size and configuration of ridges 311—311, the spacing between the ridges, and the position of the ridges with respect to the sides are effective to confine in parallel relationship the conductors 32—32. In addition, the troughs 312—312 have a horizontal portion 313 towards a free end 312 of the cover 300 and an inclined portion 314 oriented toward a cord-input end 320 of the cover. The inclined portion 314 of the troughs 312—312 extend at approximately the same angle as the inclined portion 211 of the surface 207. Furthermore, the inclined portion 314 terminates in a channel 316 lying between the inclined portion and a transverse wall 317 (see FIG. 21).

A cord inlet portion 321 comprising a horizontal surface 322 joined to a convex surface 323 is positioned to the rear of the transverse wall 317 with the convex surface curving continuously from the horizontal surface toward the oppositely facing surface of the cover 300. The horizontal surface 322 has the same location with respect to the cord-input end 320 of the cover 300 as the horizontal surface 216 with respect to the cord-input end 205 of the base. In addition, the convex surface 323 has generally the same radius of curvature as the convex surfaces 217 of the base. Consequently, the inlet portion 321 of the cover 300 has generally the same configuration and location as the inlet portion 217 of the base 200.

Figure 21:
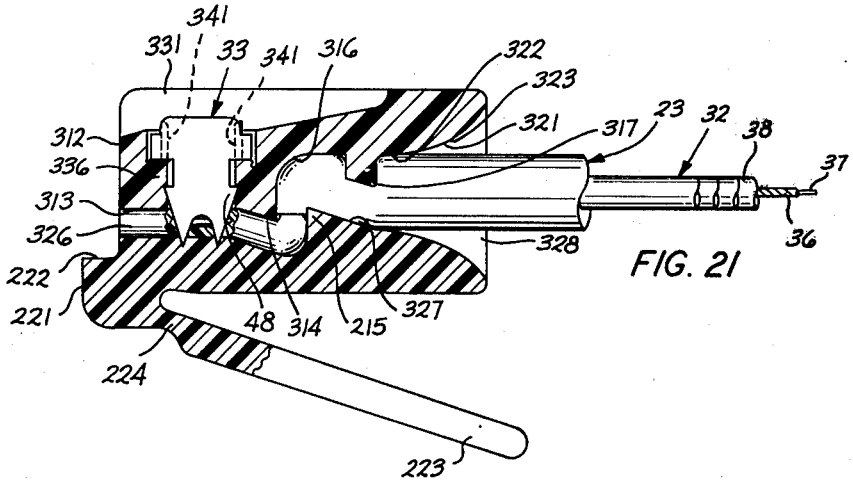

When the cover 300 is mated the base 200, the troughs 312—312 cooperate with the surface 207 to form ducts 326—326 as shown in FIG. 21 to accommodate the insulated conductors 32—32. The ducts 326—326 open to the free end 201 of the housing 199 extend horizontally and then incline toward the center of the housing.

Adjacent the internal ends of the ducts 326—326, the protuberance 215 of the base 200 cooperates with the channel 316 and the transverse wall 317 in the cover 300 to form a constricted tortuous passageway 327. The passageway 327 includes two sharp turns, the opposing surfaces of which are spaced closer together than the height of the cord 23 positioned therein.

Finally, the inlet portion 217 of the base 200 cooperates with the inlet portion 323 of the cover 300 to form a flared inlet 328. The horizontal surfaces 216 and 322 are spaced from one another so that the narrow portion of the inlet 328 has approximately the same configuration as the cord 23, while the convex surfaces 217 and 321 provide the continuously diverging or flared inlet 328.

Turning now to FIGS. 19 and 20, the cover 300 further includes a plurality of spaced fins 330—330 which define terminal-receiving openings 331—331, each of which extends between the upper surface of the cover and the side of an individual duct 326. Each opening 331 comprises a groove 332 which communicates with the top surface that overlies and extends parallel to the associated duct 326. Each opening 331 further comprises a slot 333 that communicates directly with the associated duct 326 and a recess 334 intermediate the groove and the slot, the recess being larger than the slot 333 and including abutments 336—336.

Referring now to both FIGS. 20 and 21, the terminals 33—33 adapted to be received in the openings 331—331 are as described hereinbefore. The tangs 42—42 are sized to pass through the terminal-receiving openings 331—331 and pierce the insulation of and penetrate the conductor contained in the associated duct 326. The ends of the barbs 48—48 are spaced slightly further apart than the sides of the associated slot 333 to penetrate the material defining the slot. Similarly, the lower portion is of a size to pass through the slot 333 while the shoulders 46—46 are of a size to substantially occupy the recess 334 and engage the abutments 336—336 when the terminals are seated fully within the cover 300.

The portion of the housing 199 to which the terminal-receiving slots 333—333 open is constructed to include a plurality of support webs 341—341 (see FIG. 20), with each of the support webs spanning and molded integrally with adjacent ones of the fins 330—330. The support webs 341—341 and associated fins 330—330 cooperate to form a plurality of compartments for receiving ones of the terminals 33—33.

Each of the support webs 341—341 is constructed to provide for embedment of one of the barbs 48—48 of an associated one of the terminals 33—33 and for a pinching engagement of portions of the flat portion 41 of an associated terminal, as described hereinbefore with respect to the unipartite housing 35. Moreover, each web 341 is designed such that upon application of a force through a ground-ram surface to the edge surface 43, the web is reformed to permit the terminal 33 to be moved from its temporary to a fully seated position.

The webs 341—341 are formed to support the terminals 33—33 securely in a partially assembled position while preventing unintended linear as well as unintended pivotal movement during shipment and field handling. Moreover, the terminals 33—33 in the temporary support position have the plane of each one aligned axially with the associated duct 326 to facilitate electrical engagement subsequently with the conductor 32 received therein.

In the assembly of the base 200, the cover 300 with the terminals 33—33 partially assembled thereto, and the cord 23, the jacket 32 is first stripped far enough from an end of the cord 23 so that the length of the insulated conductors 32—32 thereby exposed in somewhat greater than the length of the ducts 326—326. The cord 23 is then oriented so that the insulated conductors 32—32 lie in the same plane as the surface 207 in the base 200, and the jacketed end of the cord is positioned between the tongues 206—206 of the base.

The cover 300 is positioned so that the horizontal mating surfaces 303—303 and inclined mating surfaces 304—304 thereof are respectively oriented in the same manner as the horizontal mating surfaces 203—203 and inclined mating surfaces 204—204, respectively, of the base 200, and the cover is mated with the base. The tongues 206—206 in the base 200 are inserted into the notches 306—306 in the cover 300 to guide the cover into proper registration with the base whereby the troughs 208—208 are juxtaposed with the troughs 312—312, the channel 316 is juxtaposed with the protuberance 215, and the inlet portion 216 is juxtaposed with the inlet portion 321.

As the cover 300 is mated with the base 200, the transverse wall 317 of the cover presses into the cord 23 to hold it in place and the ridges 311—311 cooperate with the surface 207 to properly locate each insulated conductor 32 within the cavity 208. The snubbing action of the inclined portion 211 in engagement with the insulated conductors 32 serves to retract the conductors from the ends of the ducts 326. The free ends of the insulated conductors 32—32 which extend beyond the forward end of the ducts 326 are advantageously trimmed using the flat surface 222 as an anvil as the cover 300 is mated with the base.

The cover 300 is advantageously joined to the base 200 by ultrasonic bonding, for example, with energy directors (not shown) being provided on ones of the mating surfaces to facilitate this operation. With the cover 300 and base 200 joined together, the constricted tortuous passageway 327 thereby formed tightly grips the cord 23 so that any longitudinal tension on the cord is not transmitted to the conductors 32 in the ducts 326. Furthermore, the flared inlet 328 prevents any sharp flexure of the cord 23 from being transmitted to the portion of the cord located within the constructed tortuous passageway 327.

Figure 13:
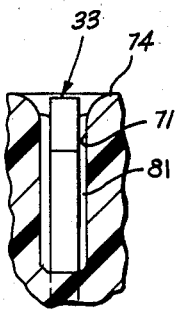

Subsequently, at another station, for example, in the manufacturing environment, an operator operates a tool to apply forces to the edge surfaces 43—43 of the terminals 33—33 whereupon the terminals are moved in the opening 331 from the initial position to a fully seated position (see FIG. 21) wherein webs 341—341 interact with the terminals as shown in FIGS. 13 and 19. The tangs 42—42 pierce the insulation of and penetrate the conductors 32—32 contained while the barbs 48—48 bite into the walls of the slots 333—333 to lock the terminals 33—33 in place.

The engagement of the webs 341—341 with shoulders 46—46 as described hereinbefore with respect to the unipartite housing 35 serves to properly stabilize the terminals 33—33 within the openings 333. The crown surface of each terminal 33 serves as the external contact portion of the terminals 33 in that it is positioned within the groove 332 of the opening 331 and is therefore exposed to the exterior of the housing 199. The reformation of the webs 341—341 contiguous the abutments 336—336 must be such as to control the movement of the tangs 42—42 of each of the terminals into the associated duct 326 and into electrical engagement with the conductor 32 therein. As discussed hereinbefore with the unipartite housing 35, overtravel or undertravel of the terminals 33—33 may also affect adversely the character of the electrical engagement thereof with the external components 27—27.

It is to be understood that the above-described arrangements are simply illustrative of the invention. Other arrangements may be devised by those skilled in the art which will embody the principles of the invention and fall within the spirit and scope thereof.

What is claimed is:

1. A device armed with a terminal for making an electrical connection with a conductor and for engaging electrically a component external to the device, which comprises:

a dielectric housing which includes a conductor-receiving cavity and a terminal-receiving opening which communicates with the cavity, the terminal-receiving opening including a slot overlying and extending generally parallel to the cavity, the length of the slot being exposed to an exterior surface of the device;

an electrically conductive blade-like terminal seated partially within the terminal-received opening and having essentially flat parallel side surfaces spaced apart by end surfaces and which includes an internal contact portion that extends into the cavity when the terminal is fully seated within the housing to pierce the insulation of and make electrical engagement with a conductor inserted into the cavity and an external contact portion for engaging electrically a component external to the connector, the terminal having barbs formed on end surfaces thereof; and means formed integrally with the housing between the slot and the exterior surface of the housing and further defining the terminal-receiving opening for supporting the terminal within the opening in a partially seated position to space the internal contact portion above the cavity with the barbs being embedded in portions of the housing which define the terminal-receiving opening and with portions of the side surfaces of the terminals adjacent the end surfaces extending through and being held in clamped engagement by portions of the supporting means to prevent unintended linear and pivotal movement of the terminal, the supporting means capable of having other portions thereof displaced upon insertion forces being applied to the terminal subsequent to insertion of a conductor into the cavity to permit the terminal to be moved further into the opening to embed the barbs in the material defining the slot and seat fully the terminal within the housing, the displacement of other portions of the supporting means causing portions of the supporting means adjacent the displaced portions to be in clamping engagement with the side surfaces of the terminal, the clamping engagement of the supporting means with the terminal and the embedding of the barbs in the material defining the slot cooperating to stabilize the terminal and prevent unintended movements thereof.

2. The device of claim 1, wherein the means for supporting the terminal within the opening in a partially seated position includes a web formed integrally with the housing at each end of the opening and transverse thereof, the terminal also being formed with shoulders on the end surfaces cantilevered out therefrom beyond the webs, the shoulders of the terminal in the partially seated position having sheared through portions of the webs such that portions of the webs adjacent the displaced portions of the webs are in clamping engagement with portions of the shoulders of the terminal.

3. The device of claim 2, wherein the terminal is formed with tangs spaced along one edge thereof and the application of forces to the partially seated terminal shears through additional portions of the webs to provide additional clamping engagement of the webs with the shoulders which cooperates with the barbs penetrating the walls defining the slot of the terminal-receiving opening to secure the terminal in a fully-seated position with the tangs engaging electrically a conductor inserted into the cavity.

4. The device of claim 3, wherein the dielectric housing includes a free end and a conductor-input end opposite to the free end, the conductor-receiving cavity opening to the conductor-receiving end and being spaced from the free end by the wall.

5. The device of claim 3, wherein the connector includes a plurality of conductor-receiving openings and is adapted to receive a plurality of conductors, the conductor-receiving cavity including a plurality of partitions which define parallel conductor-receiving troughs and which extend from a floor of the cavity to the surface to which the terminal-receiving openings open, the terminal-receiving openings overlying and extending generally parallel with the troughs.

6. The device of claim 5, wherein the dielectric housing includes a free end and a conductor-input end opposite to the free end, the conductor-receiving cavity opening to the conductor-input end and being spaced from a free end by a wall.

7. The device of claim 3, wherein the connector includes a plurality of conductor-receiving openings and is adapted to receive a plurality of conductors, the conductor-receiving cavity including a plurality of partitions which define parallel conductor-receiving troughs, the terminal-receiving openings overlying and generally parallel to the conductor-receiving troughs, the partitions extending partially from a floor of the cavity toward the surface to which the terminal-receiving openings open.

8. The device of claim 7, wherein the dielectric housing includes a free end and a conductor-input end opposite to the free end, the conductor-receiving cavity opening to the conductor-input end and being spaced from a free end by a wall.

9. The device of claim 8, wherein the wall being constructed to have a plurality of openings aligned with the troughs to receive ends of the conductors.

10. The device of claim 1, wherein the dielectric housing is an unipartite dielectric housing having one free end with internal surfaces of the housing defining the cavity that opens to the other end of the housing for receiving and substantially enclosing an end portion of a cord, with at least one portion of the housing adjacent the cavity being disposed in an initial position in a well and connected pivotally to the remainder of the housing toward the free end thereof, the pivotally connected portion having two intersecting externally facing surfaces, one of which has a stop formed thereon, the pivotally connected portion capable of being moved from the initial position to an actuated position at least partially into the cavity to clamp portions of the cord, and with a portion of the one externally facing surface of the pivotally moveable portion engaging an inwardly facing surface of the cavity of the remainder of the housing adjacent the cord-input end of the housing and the stop engaging a wall of the well adjacent the inwardly facing surface, the dual engagement of the one surface and of the stop with portions of the housing being effective to maintain the pivotally moveable portion in locked engagement with the cord during the application of retrograde forces to the cord.

11. The device of claim 10, wherein the pivotally moveable portions of the housing includes an anchoring member connected at one end through a hinged portion oriented toward the free end of the housing and the other end of the anchoring member oriented toward the cord-input end of the housing is connected by a frangible portion severably to the remainder of the housing so that the application of forces for moving the anchoring member from the initial to the actuated position causes the other end of the anchoring member to be separated from the remainder of the housing.

12. The device of claim 10, which also includes a conductor-restraining bar formed integrally with the housing and disposed within an opening in the housing which is interposed between the well and the terminal-receiving openings and which communicates with the cavity, the restraining bar separated partially from the remainder of the housing by a first slot oriented toward the free end of the housing and a second slot oriented toward the cord-input end of the housing, the second slot extending substantially further from the opening to the cavity than the first, the application of forces to the bar causing the bar to be reformed and upset into the cavity into engagement with the conductors in the cavity and causing the bar to fracture from the second slot to the cavity with relative displacement of the bar along the line of fracture to lock portions of the bar adjacent the second slot in engagement with the remainder of the housing and the cord.

13. The connector of claim 1, wherein the housing includes mating dielectric parts with one of the mating parts having terminal-receiving facilities formed therein which include a plurality of stepped openings with a narrow slot portion of the openings communicating with the conductor-receiving cavity formed when the parts are mated, the wider portions of the openings communicating with an external surface of the connector and being separated from one another by fins formed integrally with the one part.

14. The connector of claim 13, wherein the means for supporting the terminals in a partially seated position includes a plurality of transverse webs at each end of the terminal-receiving openings, each of the webs spanning between and connected integrally with the walls which enclose the wider portion of each of the stepped openings.

15. The connector of claim 13, wherein the terminal is formed with end portions cantilevered out from the barbs in the plane of the terminal and extending through the web with portions of the web being in clamping engagement with the cantilevered portion when the terminal is in the partially seated position, the application of forces to the terminal causing portions of the webs to be displaced to provide clamping engagement of the web with additional portions of the cantilevered portions of the terminal which cooperates with the barbs penetrating the walls defining the slot of the terminal-receiving opening when the terminal is moved to the secured fully seated position.

16. A device for terminating a cord, which includes;

a dielectric housing which includes a conductor-receiving cavity and a plurality of stepped terminal-receiving openings which communicate with the cavity, the terminal receiving openings having a plurality of spaced fins parallel to the cavity and formed integrally and extending from a terminal-receiving surface of the housing to an inner surface, each of the terminal-receiving openings further including a slot overlying and extending generally parallel to the cavity, the length of the slot being exposed to but spaced from the terminal-receiving surface of the device; and a web at each end of each slot extending between the inner surface toward the terminal-receiving surface and connected integrally to adjacent ones of the fins which define the upper portion of the terminal-receiving openings with portions of the web displaced by portions of an associated terminal received in the opening such that portions of the web reform into clamping engagement with portions of the terminal and cooperating with portions of the housing which define the associated slot to hold the associated terminal first in a partially seated position with internal contact portions of the terminal spaced above the cavity to permit insertion of a conductor into the cavity and subsequently in a fully seated position with the internal contact portions in electrical engagement with the conductor, the terminal in each of said positions being held against unintended pivotal and linear movements.

* * * * *